United States Patent [19]

Kurashima

[11] Patent Number: 4,566,155

[45] Date of Patent: Jan. 28, 1986

[54] SEPARABLE SPRING-LATCHED CUFFLINK WITH TRANSVERSALLY PRESSABLE RELEASE LEVER

[76] Inventor: Hideo Kurashima, 5-12. Negishi 1-chome Taito-ku, Tokyo, Japan

[21] Appl. No.: 615,909

[22] Filed: May 31, 1984

[30] Foreign Application Priority Data

Jun. 1, 1983 [JP] Japan ..... 58-83478[U]

[51] Int. Cl.[4] ..... A44B 5/00

[52] U.S. Cl. ..... 24/41; 24/43; 24/45; 24/676; 24/90 A

[58] Field of Search ..... 24/41, 42, 43, 44, 45, 24/46, 47, 113 MP, 108, 453, 662, 674, 676, 90 A

[56] References Cited

U.S. PATENT DOCUMENTS

| | | | |
|---|---|---|---|
| 376,500 | 1/1888 | Adams | 24/43 |
| 641,592 | 1/1900 | Johnson | 24/42 |
| 644,894 | 3/1900 | Carlin | 24/43 |
| 883,634 | 3/1908 | Fox | 24/45 |
| 1,268,278 | 6/1918 | Read | 24/674 |
| 1,484,807 | 2/1924 | Baker et al. . | |
| 1,585,478 | 5/1926 | Fife . | |
| 3,777,336 | 12/1973 | Anderson | 24/113 MP |
| 4,242,776 | 1/1981 | Kurashima | 24/41 |
| 4,361,936 | 12/1982 | Kurashima | 24/41 |
| 4,441,234 | 4/1984 | Kurashima | 24/41 |

FOREIGN PATENT DOCUMENTS

| | | |
|---|---|---|
| 65868 | 1/1982 | European Pat. Off. . |
| 726752 | 4/1933 | France . |
| 952314 | 11/1949 | France . |
| 2207661 | 6/1974 | France . |
| 50-40262 | 10/1978 | Japan . |
| 50-163503 | 10/1978 | Japan . |
| 50-169845 | 10/1978 | Japan . |
| 17549 | 12/1916 | United Kingdom . |

*Primary Examiner*—Victor N. Sakran

*Attorney, Agent, or Firm*—Cushman, Darby & Cushman

[57] ABSTRACT

A cufflink is provided in two parts, namely a decorative head member and a link member with a shank and a flange with a shirt cuff button hiding recess. The decorative head has an opening formed in its rear plate, which opening is normally partially obstructed at two diametrically opposed sites by respective limbs of a spring. The tip end of the shank is grooved to be caught between the spring limbs. For assembling the cufflink through a shirt cuff, the tip of the shank is inserted in the opening in the rear plate of the decorative head and the two members are pressed together until the spring limbs catch in the shank grooves. For release, a lever on the side of the head is pressed transversally of the head, forcing the spring limbs temporarily apart and thus freeing the shank tip for withdrawal from the head rear plate opening.

3 Claims, 6 Drawing Figures

SEPARABLE SPRING-LATCHED CUFFLINK WITH TRANSVERSALLY PRESSABLE RELEASE LEVER

FIELD OF THE INVENTION

This invention relates to a cufflink comprising a decorative member and a link member which can be linked to said decorative member so that an easy assembly and disassembly of said two members and a secure attachment between the two members are provided.

BACKGROUND OF THE INVENTION

Prior known cuff links comprise a decorative member and a link member integrally formed as a protrusion from the former, and said link member has an engagement piece which can be alternatively disposed in two positions i.e. it may elongate in the axial direction and at a right angle to the longitudinal axis of the shank of the link. In operation, first, said link is inserted into a button hole with its engagement piece in its elongated state; secondly, said engagement piece is rotated toward a direction at a right angle with respect to an axial line of said link member, so that the cufflink is secured through the button hole of the shirt's cuff.

However, such known cuff link has drawbacks, i.e., it is troublesome or difficult to insert its link which is integral with its decorative member through a button hole positioned at a backside of a shirt's cuff, and an engagement piece so often slips off as it is easily rotated when it touches another object. Furthermore, the engagement piece consists of a simple bar, and thus it has no aesthetic outlook. When it is attached on a convertible shirt's cuff, i.e. a cuff with a button hole and also a button thereon, the button and the engagement piece co-exist, which gives an unaesthetic outlook.

SUMMARY OF THE INVENTION

This invention provides a cufflink comprising a separate decorative member and a link member, to overcome drawbacks in the prior art, said link member being also provided with a decorative surface. The cuff link can be attached on a normal convertible cuff and a double folded cuff. When the cufflink is attached on the convertible cuff of the shirt, the button sewn on the cuff is hidden by a cover member of the link, thereby solving the problem of the coexistence of the button and engagement piece.

The present invention provides the cufflink wherein the two members can be easily attached and detached, and are securely held together while attached.

BRIEF DESCRIPTION OF THE ACCOMPANYING DRAWINGS

DESCRIPTION OF THE PREFERRED EMBODIMENT

Figure 1:
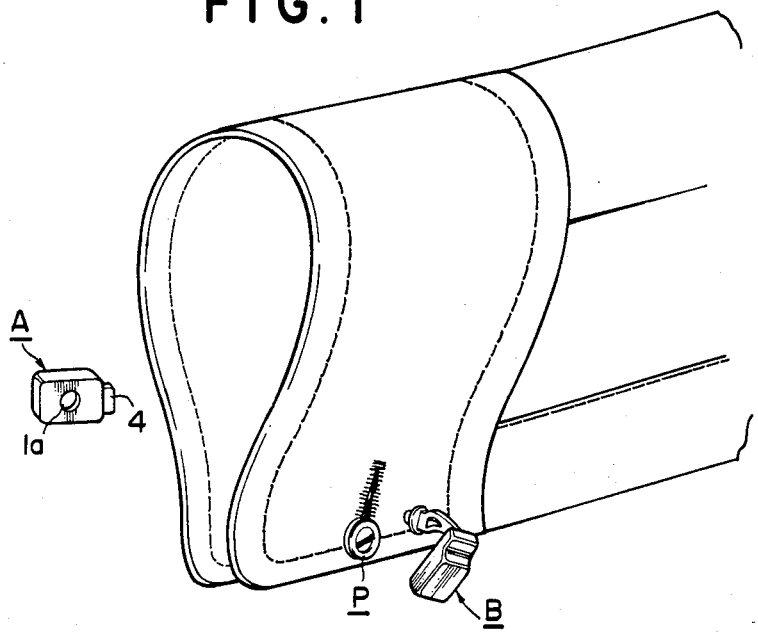
FIG. 1 is an explanatory perspective view showing a state just before linkage of the decorative member and the link member.
Figure 5:
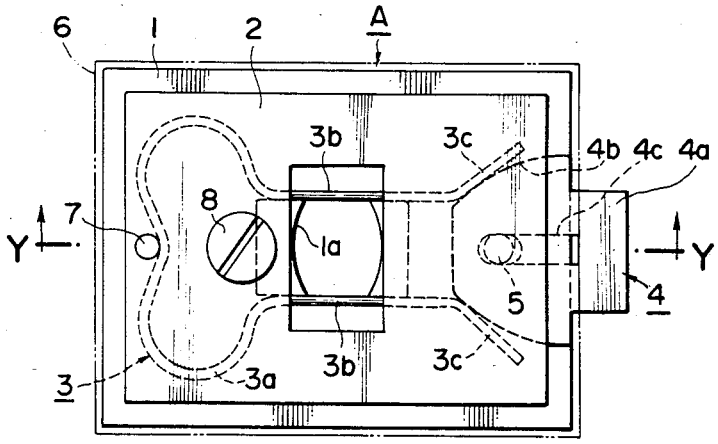
FIG. 5 is a front view of the decorative member with the decorative body omitted.
Figure 6:
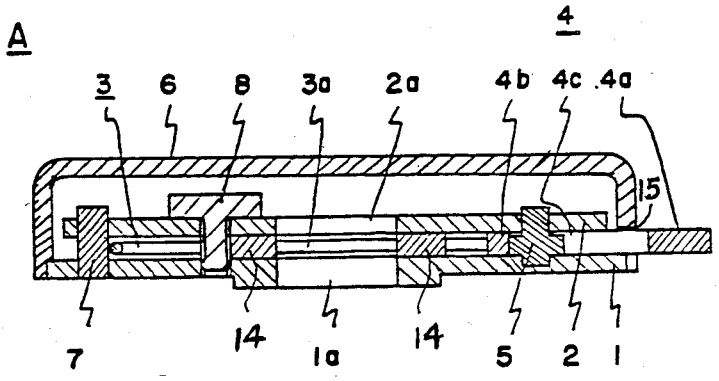
FIG. 6 is a cross section along line Y—Y in FIG. 5.

FIG. 1 shows a decorative member A and a link member B which can be detachably linked to said decorative member A, both of which constitute a cufflink, wherein, for hiding a button P on a cuff of a shirt the shank of link member B is inserted through a button hole and linked to said decorative member A, as shown in FIG. 1. The decorative member A comprises, as shown in FIGS. 5 and 6, a base plate 1 and a cover plate 2 which covers said base plate through a spacer means 14, with a certain distance. Provided through a center of the base plate 1 is an engagement hole 1*a* for receiving a head 12 of the link member shank for a purpose which is later discussed in detail, while at an opposite portion of the cover plate 2 there is provided a window 2*a* for accommodating an end portion of said head 12 which has been inserted through said hole.

Figure 2:
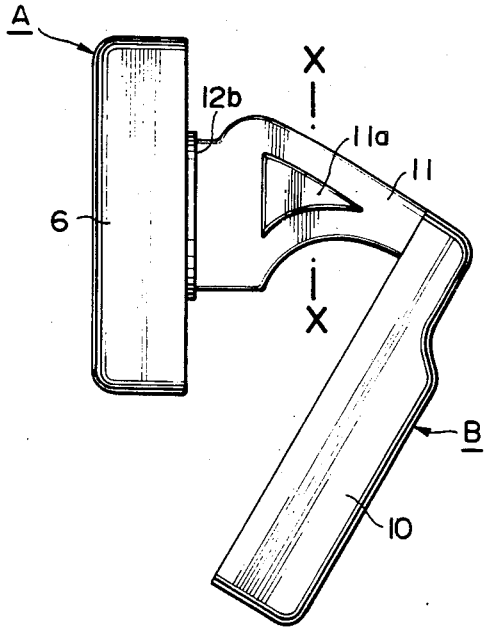
FIG. 2 is a side view of a connected state of the decorative member and the link member.
Figure 3:
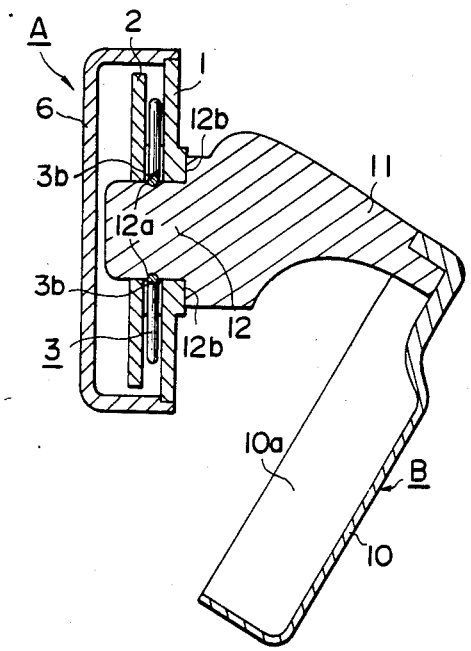
FIG. 3 is a vertical cross section of the FIG. 2.
Figure 4:
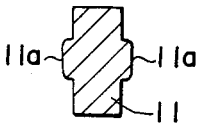
FIG. 4 is a cross section along line X—X in FIG. 2.

A spring 3 is provided between the base plate 1 and the cover plate 2 for engagement use and it comprises wire 3*a* with a resilient force, this spring being provided in a shape resembling the upper portion of a stylized heart 3*a* at its one end, in that it has two bulging lobes with a detent located medially, the two bulging lobes at their opposite ends, after converging towards one another curving concavely outwards, then straightening to provide two generally parallel straight legs 3*b* intermediate the ends thereof and two outwardly bent feet 3*c* at the opposite end thereof. An operation lever 4 is shown provided on an end of the decorative member for movement transversally of the decorative member. The lever 4 comprises a functioning member piece and a pressing piece 4*a*. The lever 4 is supported frictionally between the base plate 1 and a cover plate 2, with the pressing member 4*a* projecting out of an end of the decorative member through an appropriate slot 15. The functioning member of the lever 4 is inserted between the feet 3*c*, 3*c* of the spring 3 with its tapered rim 4*b* arranged to temporarily spread the legs of the spring 3, only for so long as the lever pressing piece 4*a* remains pressed in. An elongated guide 4*c* is provided on the lever 4 as a slot drilled along the median of the operating lever 4. With the slit 4*c* there is mated a guiding pin 5 provided in a vertical direction between the base plate 1 and the cover plate 2. By means of this pin, the operating lever 4 is stabilized for frictional movement transversally of the decorative head. The decorative member is provided with an outer covering in the form of a decorative shell 6 which is formed on its external surface an aesthetic design, symbols, numerals and with a precious stone or metal, as a shell shape, open at the back and fixed on an upper side of the cover plate 2. A pin body 7 is provided within the decorative member, mounted between the base plate 1 and the cover plate 2 and positioned to engage with the medial recess at one end of the heart shaped portion 3*a* of the spring 3 stabilizing the spring 3. A screw 8 is provided for connecting the base plate 1 and the cover plate 2 with the spacer means 14 and lever 4 sandwiched between them. The link member B, as shown in FIGS. 2 through 4 comprises a main body or shank 11 for linkage with the decorative member A with a recess 10*a* for hiding a shirt cuff button on the external surface of which an aesthetic design and symbols and the like are shown provided e.g. at 11*a*. The shank 11 is provided at its tip end with a head 12 which is constructed and arranged to be inserted into an engaging hole 1*a* provided centrally on the base plate of the decorative shell A. The head 12 of the shank of the link member B is shown provided at two diametrically opposed sites with laterally ourwardly opening dents or grooves 12*a* for receiving and holding resiliently the legs 3*b*, 3*b* of the spring.

The shank 11 is formed so as to have a transverse cross-sectional shape which is oblong or elongated for easily passing through a button hole and preventing rotation while is passing through. Protrudedly provided on both sides of the link member shank intermediate the length thereof are projections 11*a*, 11*a* for providing good mating of the two ends of the shirt's cuff.

A butting shoulder faces 12*b* are provided between the legs 3*b*, 3*b* and the grooves 12*a* in contact with at the decorative shell A, for positional mating, i.e. which engage with the base plate beside the opening 1*a* to limit incursion of the shank head into the decorative member A.

The head 12 is shaped in rather elongated form for its insertion orientation into the engagement hole 1*a* for a given opposite relationship for the decorative member A and the link B, for their linkage. However, this design form is only for mating with the cross sectional configuration of the shank 11, but the form may be any one if it has a good orientation for insertion other than a full circle.

In operation, for usage, the decorative member A and the link member B are so positioned as shown in FIG. 1, the shank B covers the button on the shirt cuff by receiving it into the recess provided in the flange 10, and the shank 11 is inserted through the button hole. For a double cuff shirt, such covering of the button is not usually necessary. After that, the head 12 protruded from the button hole is inserted into the the engagement hole 1*a* of the shell B whereby linkage of the decorative and link members is completed.

When detaching the members A and B, a pushing in of the operating lever 4, on the member A causes the functioning member 4*b* to insert between the feet 3*c*, 3*c* of the spring 3 so as to spread these feet, and the legs 3*b*, 3*b* are urged in laterally opposite directions from their mating positions in the engagement grooves 12*a*, 12*a* of the head 12. Thus, the engagement against the head 12 is released so that the decorative member A and the link member B is released. On the other hand, the operating lever 4 affects its pressing energy to the functioning member 4*b* based on a repulsive energy of the feet 3*c*, 3*c* at the spring 3. Thus, the lever 4 automatically returns to its initial state when released.

I claim:

1. A separable, spring-latched cufflink with a transversally pressable release lever, said cufflink comprising:

a link member including a shank with a head provided at one end thereof and a cuff-engaging flange provided at an opposite end thereof;

said shank, being said head thereof, being of non-circular, elongated transverse cross-sectional shape so as to have a predisposed angular orientation relative to a set of shirt cuff button holes when inserted therethrough;

means providing a pair of two diametrically opposed, laterally outwardly opening grooved in said head of said shank, these grooves being oriented generally crosswise of said shank;

means defining a shoulder on said shank constructed and arranged for limiting incursion of said head into an opening;

a decorative member including a base plate having means defining an opening therethrough which is constructed and arranged to receive said head of said shank up to said shoulder means;

a decorative shell mounted to said base plate so as to frontally cover said decorative member externally of a shirt cuff against which said decorative member becomes abutted when in use;

a spring mounted on said base plate and covered by said decorative shell;

said spring comprising a resilient wire which is heart-shaped at one end and has two laterally spaced, generally parallel limbs integrally extending therefrom as intermediate portions thereof, these limbs terminating in obliquely angled-out feet an an opposite end of said spring, said spring at said one end being thereby provided with a medially located detent;

two pins mounted to said base plate medially thereof so as to extend within said decorative shell in the thickness direction of said decorative shell, near opposite ends of said shell;

one of said pins, located externally near one end of said decorative member engaging said spring within said recess of said spring;

means defining a slot into said decorative member at said opposite end thereof;

a push lever having means defining a medially located slot therein by means of which said push lever is penetrated by the other of said pins and held thereby for limited movement transversally of said decorative member;

said push lever having an end portion extending out of said decorative member through said slot in said opposite end of said decorative member;

means defining two divergent, laterally outwardly facing opposite side cam surfaces on said push lever within said decorative member, respective ones of these cam surfaces being in engagement between and with respective feet of said spring, so that while said push lever remains unpushed, said limbs of said spring remain disposed in partially obstructing relation with said opening through said base plate so that when said shank head, with said shank properly angularly oriented, is pushed into said opening, said spring legs are free to resiliently snap into said grooves in order to secure said cufflink together through the buttonholes of a shirt-cuff, but so that said push lever when pushed, acting on said feet of said spring, temporarily cams the spring limbs apart sufficiently to permit said shank head to be withdrawn from said opening in order to detach said link member from said decorative member.

2. The cufflink of claim 1, wherein:

said flange on said link member includes a recess constructed and arranged for receiving and thus hiding a button of a convertible cuff.

3. The cufflink of claim 1, wherein:

said shank on said link member includes two opposite laterally outwardly projecting decorative bosses constructed and arranged for maintaining desired shirt cuff positioning when said cufflink is in use.

* * * * *